United States Patent [19]

Deters

[11] 4,353,610

[45] Oct. 12, 1982

[54] ELECTRICAL CONDUCTING STRIP

[75] Inventor: Paul M. Deters, Manhattan Beach, Calif.

[73] Assignee: Bussco Engineering, Inc., El Segundo, Calif.

[21] Appl. No.: 165,038

[22] Filed: Jul. 1, 1980

[51] Int. Cl.[3] ..... H01R 31/08

[52] U.S. Cl. ..... 339/19

[58] Field of Search ..... 339/19, 22 B, 222, 95 D

[56] References Cited

U.S. PATENT DOCUMENTS

| | | | |
|---|---|---|---|
| 3,668,606 | 6/1972 | Walter | 339/19 |
| 4,001,490 | 1/1977 | Lynch | 339/19 X |
| 4,223,971 | 9/1980 | Dola et al. | 339/95 D |

*Primary Examiner*—Joseph H. McGlynn
*Assistant Examiner*—Frank H. McKenzie, Jr.
*Attorney, Agent, or Firm*—Jack C. Munro

[57] ABSTRACT

An electrical conducting strip to form an electrical conducting path between a plurality of terminal posts within a bus bar. The electrical conducting strip is to include a plurality of spaced-apart opening arrangements with each opening arrangement being adapted to connect with a terminal post. Each opening arrangement includes an access opening and an engaging opening. The terminal post is to enter the opening arrangement through the access opening and then move longitudinally until the side walls of the engaging opening tightly clamp the terminal post.

10 Claims, 4 Drawing Figures

ELECTRICAL CONDUCTING STRIP

A bus bar is a very common device used within electrical equipment. The bus bar includes a housing from which extends rows of terminal posts. There may be six, eight, ten or more rows of terminal posts with at least fifteen to twenty posts per row.

In the constructing of the bus bar for its particular intended use, it is necessary to electrically ground certain ones of the terminal posts. As for example, within a single row of the terminal posts, six or eight of the posts might be electrically grounded and possibly others within that row would be electrically bypassed.

In the past, there has been a common technique known as wire wrapping in which an electrical wire is extended from post to post and wrapped about each of the terminal posts in the form of a coil in order to electrically ground the desired number of terminal posts. This technique is extremely time consuming and therefore, extremely costly in labor.

Previously, it has been known to employ an elongated metallic strip which is capable of functioning as a common electrical ground for a plurality of terminal posts of a bus bar. The use of prior art strips have certain advantages, some of which are that they are capable of bypassing certain posts, are easily installed, a physically tight connection with each terminal post is created, and manufacturing cost is reasonable. However, there is a need for an improved version of such a strip which is capable of carrying a satisfactory amount of electrical current.

SUMMARY OF THE INVENTION

The structure of this invention is to be employed in conjunction with a bus bar, wherein the bus bar includes a plurality of rows of elongated electrical connecting members which are commonly referred to as terminal posts. An electrical conducting strip, which is formed of thin metallic material, has formed therein a plurality of spaced-apart opening arrangements. Each opening arrangement is adapted to connect with a terminal post. One type of opening arrangement includes an access opening to permit entry of the terminal post and also includes an engaging opening in which the side walls of such are flared outwardly and are located in a mirror image relationship with respect to each other. These side walls are to tightly engage with the terminal post by the strip being pulled longitudinally sufficiently so that an interference fit is established between the side walls and the terminal post. The back side of the engaging opening is formed into an outwardly extending protuberance which is to come into contact with the terminal post to further enhance the conducting of electricity and also to function as a stop defining the fully installed position of the strip. The strip may also include another type of opening arrangement which is defined as a bypass opening. A terminal post is to be locatable within the bypass opening wherein the side walls of the bypass opening are spaced from the terminal post thereby eliminating any electrical connection with that particular terminal post.

DETAILED DESCRIPTION OF THE SHOWN EMBODIMENT

Figure 1:
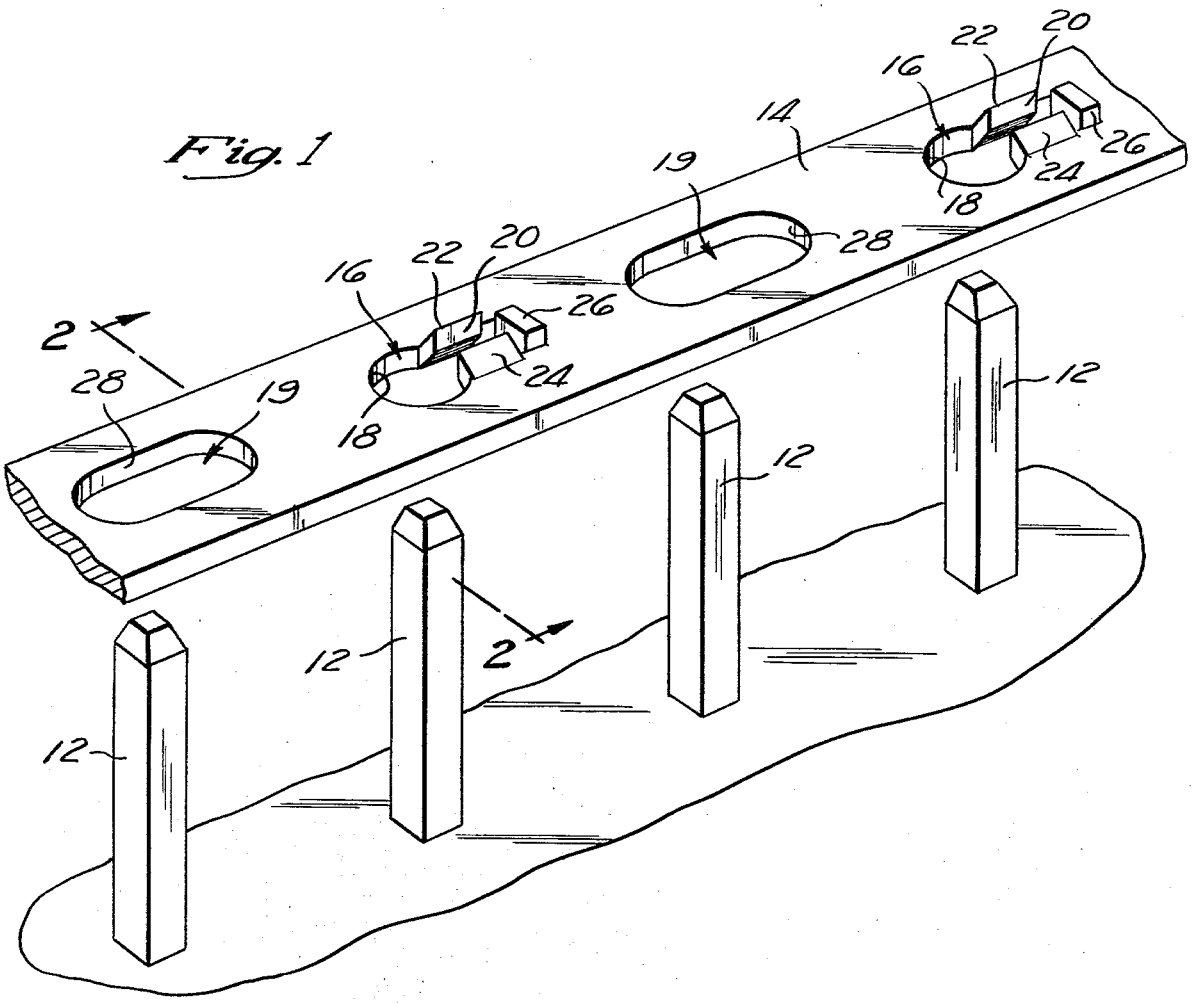
FIG. 1 is an isometric view of a portion of the electrical connecting strip of this invention showing the strip about ready to be installed upon a single terminal post of a bus bar.
Figure 2:
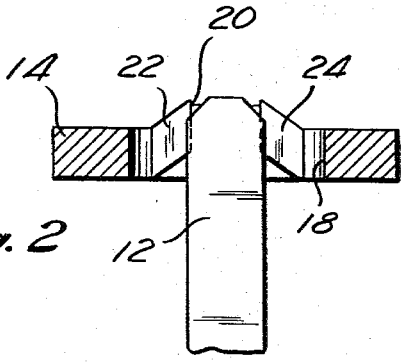
FIG. 2 is a cross-sectional view taken along line 2—2 of FIG. 1 showing the terminal post in the partly installed position in conjunction with the electrical conducting strip.
Figure 3:
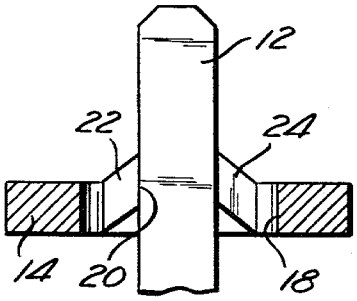
FIG. 3 is a view similar to FIG. 2 but showing the electrical conducting strip in the fully installed position on the terminal post.
Figure 4:
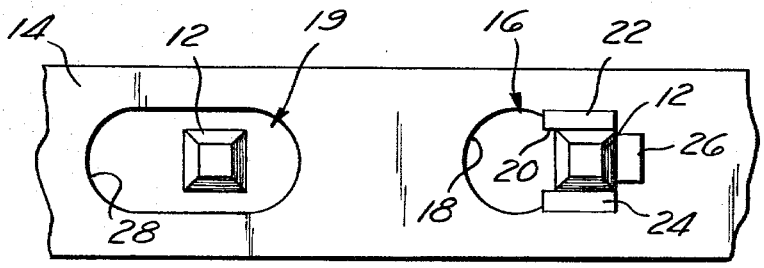
FIG. 4 is a top plan view of a portion of the electrical conducting strip of this invention showing the strip in the installed position with respect to a pair of terminal posts wherein one of the posts is being bypassed electrically.

Referring particularly to the drawing, there is shown in FIG. 1 a portion of a bus bar which has a housing 10 from which upwardly extends a metallic polygonal shaped prong in the form of a terminal post 12. It is to be understood that in the normal construction of a bus bar that there will be a series of rows of such posts 12 located in a closely spaced manner extending from the housing 10. Within each row there will be a plurality of the posts 12. It is to be understood that the posts 12 will be electrically conductive and will be connected to appropriate electrical circuitry mounted in conjunction with the housing 10. This electrical circuitry is not shown and forms no specific part of this invention.

There is to be employed with the row of terminal posts 12 the electrical conducting strip 14 of this invention. Basically, the strip 14 is constructed of thin metallic sheet material and is to have formed therein a first opening arrangement 16 and second opening arrangement 19. The location of an opening arrangement 16 or 19 is to coincide with a terminal post 12. In other words, the spacing from the center point of the opening arrangement 16 to the next adjacent opening arrangement, whether opening arrangement 16 or 19, is to be identical to the spacing between adjacent terminal posts 12. It is also to be understood that the spacing between the terminal posts 12 are identical so therefore, the spacing between the adjacent opening arrangements 16 and/or 19 within the strip 14 will also be identical.

The opening arrangement 16 takes the form of an enlarged access opening 18 and an adjoining engaging opening 20. The engaging opening 20 is bordered by side wall members 22 and 24 and a stop member 26. The side wall members 22 and 24 are located in a mirror image relationship with respect to each other. The side wall members 22 and 24 are upwardly and outwardly flared members which inherently have a certain amount of resiliency or springiness. The stop member 26 is an outwardly protruding member which is located substantially at a right angle to the exterior upper planar surface of the strip 14.

The spacing between the outer edge of the member 22 and the outer edge of the member 24 is a few thousanths of an inch less than the width of the terminal post 12. The reason for this will be explained further on in the specification.

The second opening arrangement 19 basically takes the form of an enlarged oblong shaped aperture 28. The width of the aperture 28 is substantially greater than the width of the terminal post 12. The terminal post 12 is to be centrally positioned within the opening 28 with there being an air space formed on each side of the post 12. The purpose of the opening 28 is to function as a bypass so that there will be no conducting of electricity between the strip 14 and this terminal post 12. The actual air gap on each side of the terminal post 12 will normally amount to no more than approximately one eighth of an inch.

The operation of the electrical conducting strip 14 of this invention is as follows: The strip 14 is selected and cut to its desired length. A typical width for the strip 14 will be ninety thousanths of an inch. It is envisioned that initially the strip 14 will include only first opening arrangements 16. If it is desired to employ second opening arrangements 19 at particular specific locations, the operator would merely change an opening arrangement 16 to an opening arrangement 19 by punching out the metallic material which would include the side walls 20 and 22 and the stop 26. The operator then places the strip 14 over the desired row of terminal posts 12 having the correct terminal posts 12 cooperate with the desired opening arrangement 19 and other terminal posts 12 cooperating with opening arrangement 16.

The terminal post 12 located within the opening arrangement 16 will be positioned within the access opening 18. Normally, the operator will place the strip 14 adjacent the housing 10. The operator now grasps the left end (according to FIG. 1) of the strip 14 and gives a forceful sharp jerk in order to cause the terminal post 12 within each access opening 18 to be forcibly located between side wall members 22 and 24 forming an interference fit therebetween. It is to be noted that, as previously mentioned, the spacing between the side wall members 22 and 24 is such that they will be required to deflect slightly outwardly in order to accommodate the width of the post 12. The side wall members 22 and 24, having a desire to return to their normal at rest position, will press tightly against the terminal post 12. The terminal post 12 is to abuttingly contact the stop member 26 defining the limit of movement of the terminal post 12 within each engaging opening 20. As previously mentioned, a simple quick sharp jerking movement of the strip 14 will be sufficient to engage several of the terminal posts 12 with their respective engaging openings 20. With the terminal posts so engaged, the terminal post(s) 12 which are located within an opening 28 are centrally disposed in relation thereto thereby not conducting electrical current therebetween.

It is to be understood that once installed, the strip 14 will not be required to be removed. However, if removal is required, in most situations, that particular strip 14 will not be reused, but a new strip 14 will be employed.

What is claimed is:

1. An electrical conducting strip for forming a path for electricity between terminal posts of a bus bar, said electrical conducting strip comprising:

an elongated metallic member, said metallic member having a opening arrangement formed therein, said opening arrangement including an access opening and an engaging opening, said access opening being connected to said engaging opening, said access opening being of a size to readily permit entry of a terminal post, said engaging opening having a side wall assembly defining a size adapted to tightly engage a terminal post establishing an electrical connection therebetween, said elongated member to be moved longitudinally to relocate the terminal post from said access opening into said engaging opening; and stop means attached to said elongated metallic member, said stop means to connect with said engaging opening, said stop means to abut said terminal post when said terminal post is fully inserted within said engaging opening.

2. The electrical conducting strip as defined in claim 1 wherein:

said elongated metallic member being constructed of thin sheet material, there being a plurality of said opening arrangements formed within said elongated member, said opening arrangements being spaced apart.

3. The electrical conducting strip as defined in claim 1 wherein:

said elongated metallic member also including a bypass opening, a terminal post to extend to within the confines of said bypass opening but not establishing an electrical connection therebetween.

4. An electrical conducting strip for forming a path for electricity between terminal posts of a bus bar, said electrical conducting strip comprising:

an elongated metallic member, said metallic member having a opening arrangement formed therein, said opening arrangement including an access opening and an engaging opening, said access opening being connected to said engaging opening, said access opening being of a size to readily permit entry of a terminal post, said engaging opening having a side wall assembly defining a size adapted to tightly engage a terminal post establishing an electrical connection therebetween, said elongated member to be moved longitudinally to relocate the terminal post from said access opening into said engaging opening; and the innermost end of said engaging opening terminating in a stop member, said stop member being adapted to connect with the terminal post located within said engaging opening.

5. The electrical conducting strip as defined in claim 4 wherein:

said elongated metallic member having a substantially planar exterior surface, said stop member protruding outwardly from said planar exterior surface.

6. The electrical conducting strip as defined in claim 1 wherein:

said side wall assembly of said engaging opening comprising a separated pair of outwardly flared side wall members located in substantially a mirror image relationship with respect to each other.

7. The electrical conducting strip as defined in claim 6 wherein:

said elongated metallic member being constructed of this sheet material, there being a plurality of said opening arrangements formed within said elongated member, said opening arrangements being spaced apart.

8. The electrical conducting strip as defined in claim 7 wherein:

said elongated metallic member also including a bypass opening, a terminal post to extend to within the confines of said bypass opening but not establishing an electrical connection therebetween.

9. An electrical conducting strip for forming a path for electricity between terminal posts of a bus bar, said electrical conducting strip comprising:

an elongated metallic member, said metallic member having a opening arrangement formed therein, said opening arrangement including an access opening and an engaging opening, said access opening being connected to said engaging opening, said access opening being of a size to readily permit entry of a terminal post, said engaging opening having a side wall assembly defining a size adapted to tightly engage a terminal post establishing an electrical connection therebetween, said elongated member to be moved longitudinally to relocate the terminal post from said access opening into said engaging opening; and said side wall assembly of said engaging opening comprising a separated pair of outwardly flared side wall members located in substantially a mirror image relationship with respect to each other;

said elongated metallic member being constructed of thin sheet material, there being a plurality of said opening arrangements formed within said elongated member, said opening arrangements being spaced apart;

said elongated metallic member also including a bypass opening, a terminal post to extend to within the confines of said bypass opening but not establishing an electrical connection therebetween; and the innermost end of said engaging opening terminating in a stop member, said stop member being adapted to connect with the terminal post located within said engaging opening.

10. The electrical conducting strip as defined in claim 9 wherein:

said elongated metallic member having a substantially planar exterior surface, said stop member protruding outwardly from said planar exterior surface.

* * * * *